US012617008B2

(12) United States Patent
Shimotani

(10) Patent No.: US 12,617,008 B2
(45) Date of Patent: May 5, 2026

(54) THICKNESS CONTROLLING METHOD AND RIGIDITY MONITORING METHOD FOR ROLLING MILL

(71) Applicant: TMEIC CORPORATION, Tokyo (JP)

(72) Inventor: Toshihito Shimotani, Tokyo (JP)

(73) Assignee: TMEIC CORPORATION, Tokyo (JP)

( * ) Notice: Subject to any disclaimer, the term of this patent is extended or adjusted under 35 U.S.C. 154(b) by 289 days.

(21) Appl. No.: 18/690,531

(22) PCT Filed: Aug. 8, 2022

(86) PCT No.: PCT/JP2022/030309
§ 371 (c)(1),
(2) Date: Mar. 8, 2024

(87) PCT Pub. No.: WO2024/033983
PCT Pub. Date: Feb. 15, 2024

(65) Prior Publication Data

US 2025/0128305 A1 Apr. 24, 2025

(51) Int. Cl.
*B21B 37/16* (2006.01)
*B21B 37/58* (2006.01)
*B21B 37/64* (2006.01)

(52) U.S. Cl.
CPC ..... *B21B 37/16* (2013.01); *B21B 37/58* (2013.01); *B21B 37/64* (2013.01)

(58) Field of Classification Search
CPC ... B21B 37/16–26; B21B 37/20; B21B 37/58; B21B 37/64
See application file for complete search history.

(56) References Cited

U.S. PATENT DOCUMENTS

2017/0341117 A1* 11/2017 Tachibana ..... B21B 37/22

FOREIGN PATENT DOCUMENTS

| | | | | |
|---|---|---|---|---|
| CN | 103286142 B | * | 1/2016 | |
| CN | 107138537 A | * | 9/2017 | ..... B21B 37/16 |
| JP | 2014-104491 A | | 6/2014 | |
| JP | 5627553 B2 | | 11/2014 | |

OTHER PUBLICATIONS

Translation of CN-107138537-A.*
Translation of CN-103286142-B.*
International Search Report and Written Opinion mailed on Sep. 6, 2022, received for PCT Application PCT/JP2022/030309, filed on Aug. 8, 2022, 8 pages including English Translation.

* cited by examiner

*Primary Examiner* — Bobby Yeonjin Kim
(74) *Attorney, Agent, or Firm* — XSENSUS LLP

(57) ABSTRACT

A thickness controlling method for a rolling mill includes using a regression model to recursively approximate a relationship between the roll force change amount between the preceding material and the present material and a gap error change amount of the rolling mill, and predicting a gap error in a rolling of the present material on the basis of the regression model, the preceding material being a rolled coil rolled by the rolling mill immediately prior, and the present material being another rolled coil to be rolled following the preceding material, correcting a gap setting amount in the rolling of the present material, on a basis of a value of the predicted gap error, and updating a regression coefficient of the regression model, on a basis of an actual roll force and an actual gap error change amount obtained from the rolling of the present material.

4 Claims, 5 Drawing Sheets

THICKNESS CONTROLLING METHOD AND RIGIDITY MONITORING METHOD FOR ROLLING MILL

CROSS-REFERENCE TO RELATED APPLICATION

This application is based on PCT filing PCT/JP2022/030309, filed Aug. 8, 2022, the entire contents of which are incorporated herein by reference.

TECHNICAL FIELD

The present disclosure relates to a thickness controlling method and a rigidity monitoring method for a rolling mill.

BACKGROUND ART

In rolling processes, to control the thickness of a material to be rolled with a high level of precision, it is necessary to appropriately set a gap between rolls of a rolling mill. When the gap is to be set, a gap setting value is determined through a calculation employing a model (a gauge meter model) used for calculating the rolling mill gap while taking into consideration gap fluctuations caused by various factors including an elastic deformation (a mill elongation) of the rolling mill caused by a reaction force (a roll force) from the material to be rolled. Accordingly, to enhance the precision level for thicknesses, it is important to improve the precision level of the gauge meter model.

The amount of the aforementioned mill elongation is dependent on the strength of the rolling mill (rolling mill rigidity) against the elastic deformation. The rolling mill rigidity is estimated from a result of a measuring test called a mill curve measuring process. A mill curve is a characteristic curve obtained as a relationship between the mill elongation amount and the roll force applied to the rolling mill. That is to say, the gradient of a mill curve expresses rigidity of the rolling mill. The gauge meter model predicts the gap, on the basis of a predicted mill elongation amount derived from the mill curve corresponding to a predicted roll force, so as to determine the gap setting value. Examples of typical mill curve measuring methods include tightening methods. According to a tightening method, while top and bottom work rolls of a rolling mill are in direct contact with each other (called a kiss roll state) having no plate therebetween, a pressing screw is tightened while the rolls are rotated. The rolling mill rigidity is estimated from a relationship between a measured tightening amount and the roll force. Because this process needs to be performed while the operation is suspended, the mill curve measuring process is not frequently performed. As a result, an estimated result based on a past measured result tends to be used for a long period of time.

In the aforementioned prediction using the gauge meter model, chronological changes in the rolling mill rigidity may impact the precision level of the calculation of the gap setting value. Both FIGS. 6 and 7 are graphs in which roll force change amounts (each being the difference between a roll force of a coil (a preceding material) rolled immediately prior and a roll force of another coil (a present material) rolled next) are plotted along the horizontal axis, whereas gap error change amounts (each being the difference between a gap error of the preceding material and a gap error of the present material) are plotted along the vertical axis. The tendency exhibited in FIG. 6 is a tendency observed when there is a small prediction error in the mill elongation amounts. No correlation is observed between the two variables, namely the roll force change amounts and the gap error change amounts. In contrast, the tendency exhibited in FIG. 7 is a tendency observed when there is a large prediction error in the mill elongation amounts. A correlation is observed between the two variables. In other words, in FIG. 7, the gap error change amounts occur as being caused by the roll force change amounts.

As explained above, the prediction error in the mill elongation amounts caused by the chronological changes in the rolling mill rigidity could be a cause of a gap error. However, because the mill rigidity is directly available only from the mill curve measuring process, it is difficult to take such an error into consideration in a rolling model.

In relation to the above, to improve precision levels of gauge meter models, PTL 1 and PTL 2 listed below have proposals. PTL 1 discloses a method by which a roll force fluctuation value that satisfies a gauge meter formula is calculated while dynamic characteristics of a rolling mill are taken into consideration, so as to calculate a correction amount for a roll gap by using the calculated dynamic characteristic roll force fluctuation value. Further, PTL 2 discloses a method by which condition items (certain operation factors and a mill elongation amount) are weighted according to similarities with past data calculated under the condition items, so as to calculate coefficients of impact imposed on the roll force by the condition items with respect to a material to be rolled in question, so as to use, in a gauge meter formula, one of the coefficients of impact (a mill constant) imposed on the roll force by the mill elongation amount.

CITATION LIST

Patent Literature

[PTL 1] Japanese Patent No. 5627553
[PTL 2] JP 2014-104491 A

SUMMARY OF THE INVENTION

Problems to be Solved by the Invention

However, neither PTL 1 nor PTL 2 is capable of directly taking into consideration the roll force change amounts, i.e., the gap error change amounts associated with the chronological changes occurring in the rigidity of the rolling mill. Further, it is not possible to grasp the chronological changes occurring in the rigidity of the rolling mill.

The present disclosure has been made in order to solve the problems described above, and a first object of the present disclosure is to provide a thickness controlling method for a rolling mill by which it is possible to calculate an appropriate gap correction amount of the rolling mill on the basis of a roll force change amount between a preceding material and a present material and it is possible to improve the precision level for thicknesses. In addition, it is a second object of the present disclosure to provide a rigidity monitoring method for a rolling mill by which it is possible to grasp changes occurring in rigidity of the rolling mill.

Solution to Problem

A first aspect relates to a thickness controlling method for a rolling mill that rolls a material to be rolled so as to have a target thickness. The thickness controlling method for a rolling mill comprises a step of using a regression model to recursively approximate a relationship between a roll force change amount between a preceding material and a present material and a gap error change amount of the rolling mill, and predicting a gap error in a rolling of the present material on the basis of the regression model, the preceding material being a rolled coil rolled by the rolling mill immediately prior, and the present material being another rolled coil to be rolled following the preceding material; a step of correcting a gap setting amount in the rolling of the present material, on a basis of a value of the predicted gap error; and a step of updating a regression coefficient of the regression model, on a basis of an actual roll force and an actual gap error change amount obtained from the rolling of the present material.

A second aspect further includes the following characteristics in addition to the first aspect. A difference is calculated between the gap error change amount predicted by the regression model by using the actual roll force and the actual gap error change amount. when the calculated difference is larger than a reference value, the regression coefficient is not updated, and a most recent regression coefficient is maintained.

A third aspect relates to a rigidity monitoring method for a rolling mill. The rigidity monitoring method for a rolling mill comprises a step of determining whether there is a chronological change in rigidity of the rolling mill on a basis of a time-series transition in the regression coefficient updated at each rolling with the thickness controlling method for the rolling mill according to the first aspect or the second aspect; and a step of issuing a notification when it is determined that the chronological change has occurred in the rigidity of the rolling mill.

Advantageous Effects of the Invention

According to the first aspect, the changes in the rolling mill rigidity are grasped as the regression coefficients of the regression model that are recursively identified. As a result, appropriate gap correction amounts are automatically calculated, so that gap setting values are calculated on the basis of the calculated gap correction amounts. Consequently, it is possible to reduce the impact imposed on the precision level of the calculation of the gap setting values by the chronological changes in the rigidity of the rolling mill, i.e., changes in thickness errors associated with roll force changes between the preceding materials and the present materials. Accordingly, it is possible to improve the precision level for thicknesses of the materials to be rolled.

According to the second aspect, by preventing the rolling mill gap from being corrected excessively, it is possible to control thicknesses with a higher level of precision.

According to the third aspect, by monitoring the regression coefficients while considering the transition of the regression coefficients in the time series as the chronological changes in the rolling mill rigidity, it is possible to grasp changes occurring in the rigidity of the rolling mill.

DESCRIPTION OF EMBODIMENTS

Figure 1:
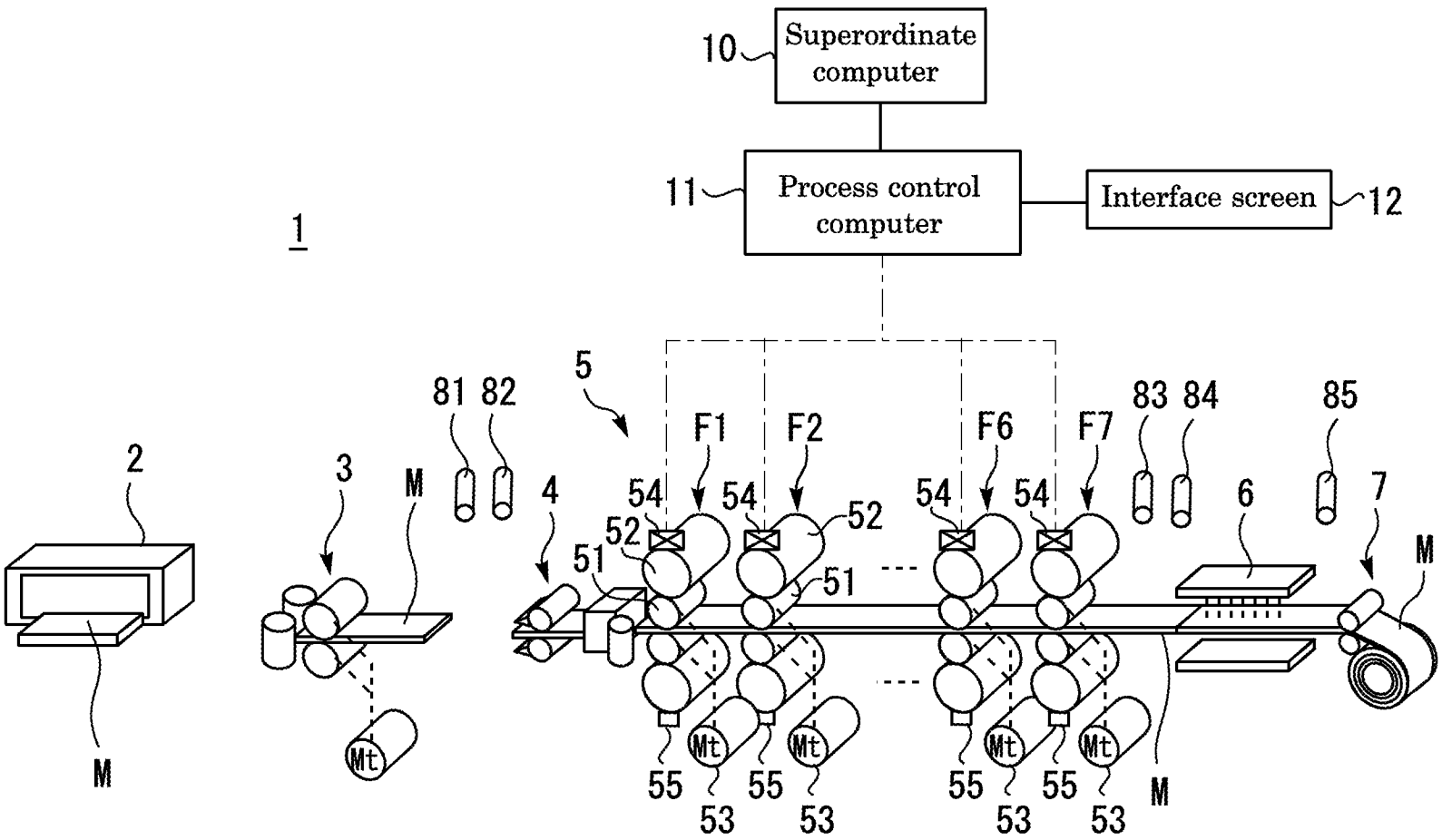
FIG. 1 is a schematic drawing depicting a system configuration of a rolling plant.

The following will describe embodiments of the present invention in detail with reference to the drawings. The elements depicted in common to two or more of the drawings will be referred to by using the same reference numerals, and duplicate explanations thereof will be omitted.

First Embodiment

FIG. 1 is a schematic drawing depicting a configuration of a rolling plant 1. By using a material made of steel or any other type of metal as a material to be rolled M, the rolling plant 1 rolls the material to be rolled M into a plate with heat.

Installed in the rolling plant 1 as primary equipment are: a heating furnace 2, a roughing mill 3, a crop shear 4, a finishing mill 5 serving as a hot rolling mill, a cooling device 6, and a coiler 7. In the present embodiment, an example will be explained in which the thickness on the delivery side of the finishing mill 5 serving as a hot rolling mill is controlled to be a very thin product target thickness (e.g., 1.0 mm or smaller).

The heating furnace 2 is configured to heat a slab being the material to be rolled M before being rolled, up to a prescribed temperature. For example, the heating temperature may be 1200° C. The slab on the delivery side of the heating furnace 2 is in a cuboid shape having a thickness of 200 mm to 250 mm, a width of 800 mm to 2000 mm, and a length of 5 m to 12 m, for example.

The roughing mill 3 has at least one (usually one to three) rolling stand and is configured to perform, on the material to be rolled M heated by the heating furnace 2, a rolling process in multiple passes in a forward direction (from the upstream side to the downstream side of a rolling line) and a backward direction (from the downstream side to the upstream side of the rolling line). The roughing mill 3 may be provided with a width adjusting device called an edger (not shown).

On the basis of a shape measured by a shape detector 81 (explained later), the crop shear 4 is configured, by using top and bottom blades, to cut off a shape defect part that is present in a head end part or a tail end part of the material to be rolled M.

The finishing mill 5 corresponds to a rolling mill of the present embodiment. The finishing mill 5 is a tandem rolling mill including a plurality of rolling stands Fi (where $1 \leq i \leq N$) that are arranged side by side along a transport direction of the material to be rolled M. In the present embodiment, an example will be explained in which seven rolling stands F1 to F7 are provided side by side. Each of the rolling stands F1 to F7 includes two (top and bottom) work rolls 51, two (top and bottom) backup rolls 52, and a motor 53 for roll rotation. The backup rolls 52 are provided with a pressing device 54. The pressing device 54 is configured to be able to adjust a gap between the top and bottom work rolls 51 (hereinafter simply referred to as "gap"). The roll forces of the rolling stands F1 to F7 are measured by a roll force sensor 55 (explained later).

The cooling device 6 is configured to be able to cool the material to be rolled M, by pouring water over the material to be rolled M while using a cooling bank. The material to be rolled M that has been cooled is wound into a coil shape by the coiler 7.

In the present embodiment, the material to be rolled M after the rolling process that has been rolled into the coil shape may be referred to as a coil. Further, a material to be rolled M or a coil that was rolled immediately prior may be referred to as a "preceding material" or an "(n−1)-th coil", whereas a material to be rolled M or a coil to be rolled may be referred to as a "present material" or an "n-th coil".

At relevant locations in the rolling plant 1, various types of sensors serving as measurement devices are installed. The relevant locations in the rolling plant 1 may be, for example, the delivery side of the heating furnace 2, the delivery side of the roughing mill 3, the delivery side of the finishing mill 5, the entry side of the coiler 7, and/or the like. The various types of sensors may also be provided between the rolling stands F1 to F7 of the finishing mill 5. The various types of sensors include: the shape detector 81 capable of measuring the shape of the material to be rolled M on the delivery side of the roughing mill 3, a pyrometer 82 that measures a surface temperature of the material to be rolled M on the entry side of the finishing mill 5, a speed detector 83 that measures a speed Va of the material to be rolled M on the delivery side of the finishing mill 5, a thickness meter 84 that measures a thickness Ta of the material to be rolled M on the delivery side of the finishing mill 5, a pyrometer 85 that measures a surface temperature of the material to be rolled M on the entry side of the coiler 7, and the roll force sensor 55 that measures the roll forces of the rolling stands F1 to F7. The various types of sensors successively measure states of the material to be rolled M and various devices.

The rolling plant 1 is operated (run) by a control system using a computer. The computer includes a superordinate computer 10 and a process control computer 11 that are connected to each other via a network. To the process control computer 11, an interface screen 12 serving as an operation screen is connected by an operator via a network.

The process control computer 11 executes setting calculation/control over an element to be controlled, during a series of rolling processes. In addition, the process control computer 11 further has a function of correcting the gap. To the process control computer 11, the superordinate computer 10 inputs slab information including a thickness, a width, a length, a steel grade, and the like of the slab being the material to be rolled M before the rolling process, as well as coil target information including a target thickness, a target width, a target temperature, and the like of the coil being the material to be rolled M after the rolling process.

Figure 2:
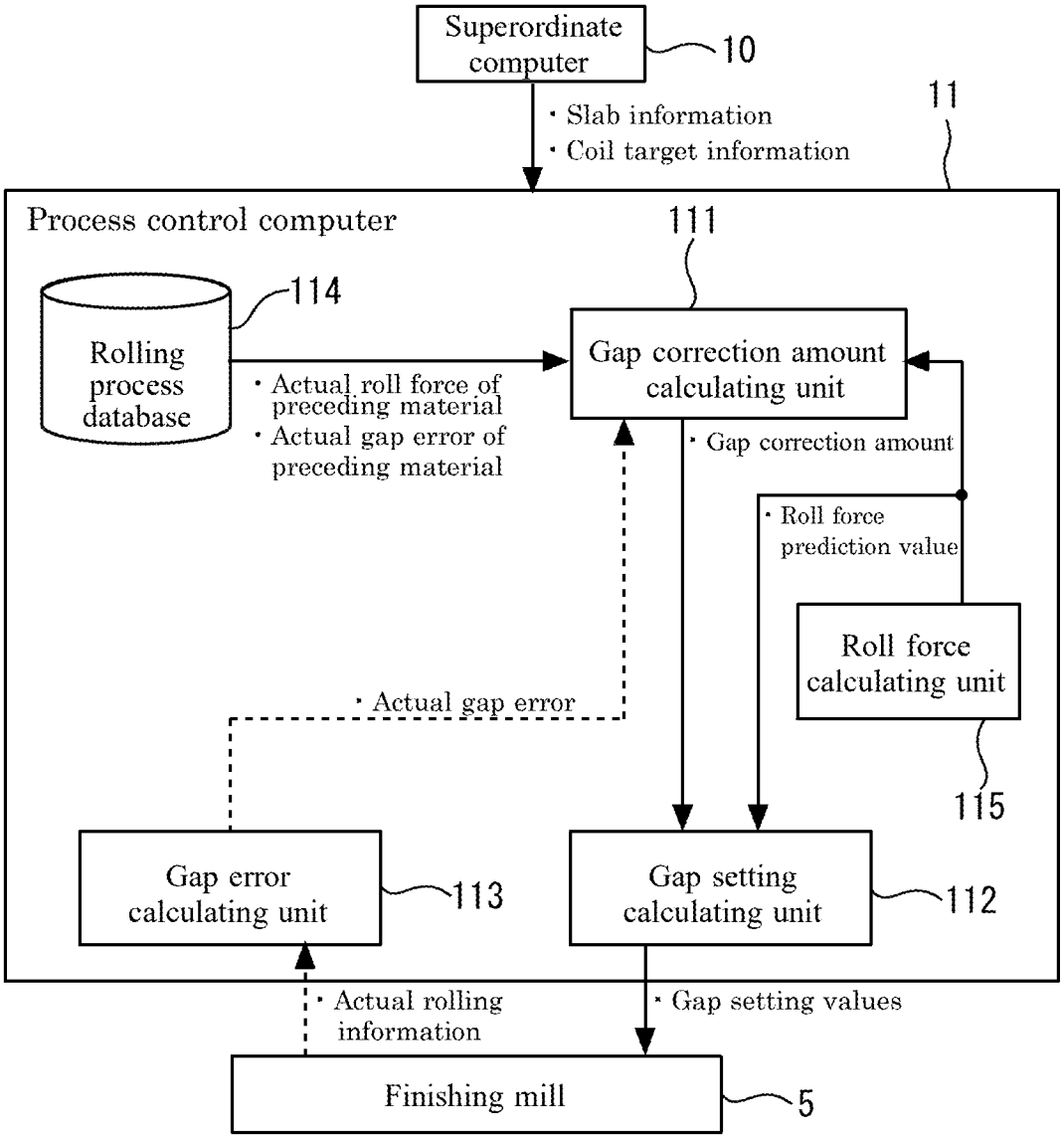
FIG. 2 is a schematic diagram indicating a configuration of a process control computer that implements a thickness controlling method for a rolling mill according to a first embodiment.

FIG. 2 is a schematic diagram indicating a configuration of the process control computer 11 that implements a thickness controlling method for a rolling mill according to the first embodiment. The process control computer 11 incudes a gap correction amount calculating unit 111, a gap setting calculating unit 112, a gap error calculating unit 113, a rolling process database 114, and a roll force calculating unit 115.

The gap correction amount calculating unit 111 has a function of calculating a gap correction amount. On the basis of an actual roll force of the preceding material and an actual gap error of the preceding material obtained from the rolling process database 114, a roll force prediction value obtained from the roll force calculating unit 115, and an actual gap error of the present material obtained from the gap error calculating unit 113, the gap correction amount calculating unit 111 calculates the gap correction amount and outputs the gap correction amount to the gap setting calculating unit 112. A specific method for calculating the gap correction amount will be explained later.

The gap setting calculating unit 112 has a function of calculating gap setting values. On the basis of the target thickness obtained from the superordinate computer 10 and the roll force prediction value obtained from the roll force calculating unit 115, or the like, the gap setting calculating unit 112 calculates the gap setting values of the rolling stands F1 to F7 and outputs the gap setting values to the finishing mill 5. Further, on the basis of the gap correction amount obtained from the gap correction amount calculating unit 111, the gap setting calculating unit 112 corrects the gap setting values and outputs the corrected gap setting values to the finishing mill 5.

The gap error calculating unit 113 has a function of calculating an actual gap error. On the basis of actual rolling information, the gap error calculating unit 113 calculates the actual gap error of the present material and outputs the actual gap error to the gap correction amount calculating unit 111.

The rolling process database 114 is configured so that past rolling data is successively stored therein. The past rolling data includes the actual roll force of the preceding material and the actual gap error of the preceding material. The actual gap error is calculated as a difference between a mass flow thickness and a gauge meter thickness. The mass flow thickness is an estimated thickness value (an actual thickness value) calculated on the basis of the law of volume velocity (mass flow) conservation, by using the actual thickness Ta and the actual speed Va measured on the delivery side of the finishing mill 5. The gauge meter thickness is an estimated thickness value (an actual thickness value) calculated from a gauge meter formula, by using the actual roll force or the like. Because methods for calculating the mass flow thickness and the gauge meter thickness are publicly known, detailed explanations thereof will be omitted herein.

The roll force calculating unit 115 has a function of calculating the roll force prediction value of the present material. The roll force calculating unit 115 calculates the roll force prediction value on the basis of the target thickness input thereto from the superordinate computer 10 or the like and outputs a result to the gap correction amount calculating unit 111 and to the gap setting calculating unit 112.

Figure 3:
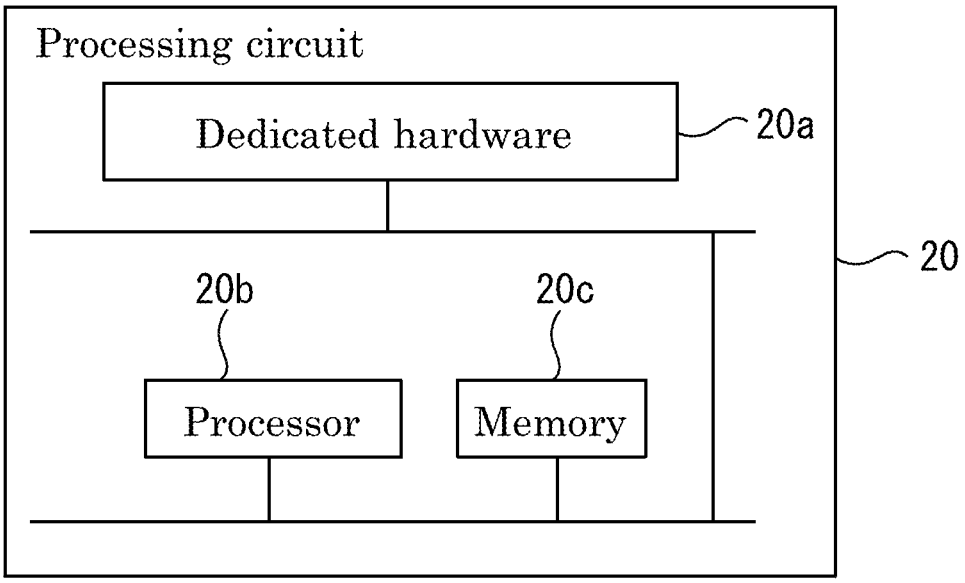
FIG. 3 is a diagram showing an example of a hardware configuration of the process control computer.

Although the specific structure of the process control computer 11 is not limited, an example can be described as follows. FIG. 3 is a diagram showing an example of a hardware configuration of the process control computer 11. It is possible to realize functions of the process control computer 11 by using a processing circuit shown in FIG. 3. The processing circuit may be dedicated hardware 20*a*. The processing circuit may include a processor 20*b* and a memory 20*c*. A part of the processing circuit may be formed as the dedicated hardware 20*a*, while the processing circuit further includes the processor 20*b* and the memory 20*c*. In the example in FIG. 3, a part of the processing circuit is formed as the dedicated hardware 20*a*, while the processing circuit also includes the processor 20*b* and the memory 20*c*.

At least a part of the processing circuit may be at least one piece of dedicated hardware 20*a*. In that situation, the processing circuit corresponds to a single circuit, a complex circuit, a programmed processor, parallel-programmed processors, an ASIC, an FPGA, or a combination of any of these, for example.

The processing circuit may include at least one processor 20*b* and at least one memory 20*c*. In that situation, functions of the process control computer 11 are realized by using software, firmware, or a combination of software and firmware. The software and the firmware are written as programs and stored in the memory 20*c*. The processor 20*b* realizes functions of functional units, by reading and executing the programs stored in the memory 20*c*.

The processor 20*b* may be referred to as a Central Processing Unit (CPU), a central processing device, a processing device, a computation device, a microprocessor, a microcomputer, or a DSP. The memory 20*c* corresponds, for example, to a non-volatile or volatile semiconductor memory or the like, such as a RAM, a ROM, a flash memory, an EPROM, or an EEPROM. It is also possible to configure the memory 20*c* so as to also serve as a database 13.

As explained above, the processing circuit is capable of realizing the functions of the process control computer 11, by using the hardware, the software, the firmware, or a combination of any of these.

Next, a thickness controlling method for the rolling mill 5 implemented by the process control computer 11 described above will be explained.

When the process control computer 11 receives the input from the superordinate computer 10, the roll force calculating unit 115 calculates the roll force prediction value of the present material and outputs the roll force prediction value to the gap correction amount calculating unit 111 and to the gap setting calculating unit 112. The gap correction amount calculating unit 111 calculates the gap correction amount and outputs the gap correction amount to the gap setting calculating unit 112. On the basis of the target thickness and the roll force prediction value, or the like, the gap setting calculating unit 112 calculates the gap setting values and outputs the gap setting values to the finishing mill 5. In accordance with the gap setting values, the finishing mill 5 controls the gaps by employing the pressing device 54 for the rolling stands F1 to F7. After the present material is rolled, the gap error calculating unit 113 calculates the actual gap error and outputs the actual gap error to the gap correction amount calculating unit 111.

The gap correction amount calculating unit 111 calculates the gap correction amount by using Mathematical Formula (1) presented below.

[Math 1]

$$\Delta S_i^{comp}[n] = \beta \cdot a[n] \cdot \Delta P_i[n] \tag{1}$$

In the above formula, i denotes numbers ($1 \le i \le 7$) identifying the rolling stands. The notation $$\Delta S_i^{comp}[n]$$

denotes the gap correction amount of an n-th coil (the present material). The letter β denotes a gain. The notation a[n] denotes a regression coefficient of the n-th coil (the present material). Further, the notation $\Delta P_i[n]$ denotes a roll force change amount between the preceding material and the present material that is input from the gap error calculating unit 113 and is calculated by using Mathematical Formula (2) presented below.

[Math 2]

$$\Delta P_i[n] = \Delta P_i^{pred}[n] - P_i^{act}[n-1] \tag{2}$$

In the above formula, the notation $$\Delta P_i^{pred}[n]$$

denotes the roll force prediction value of the n-th coil (the present material) input from the roll force calculating unit 115. The notation $$P_i^{act}[n-1]$$

denotes the actual roll force (the actual value of the roll force) of the (n−1)-th coil (the preceding material) input from the rolling process database 114.

The regression coefficient a[n] in Mathematical Formula (2) presented above is updated every time a coil is rolled. The regression coefficient a[n] is calculated by using a recursive least squares method, for example. When the recursive least squares method is used, the regression coefficient a[n] is calculated and updated according to Mathematical Formulae (3) and (4) presented below. In this manner, the regression coefficient a[n] is learned as being updated.

[Math 3]

$$a[n] = a[n-1] + \frac{p[n-1]\Delta P_i[n]}{\lambda + p[n-1](\Delta P_i[n])^2}(\Delta S_i^{act}[n] - a[n-1]\Delta P_i[n]) \tag{3}$$

[Math 4]

$$p[n] = \frac{p[n-1]}{\lambda + p[n-1](\Delta P_i[n])^2} \tag{4}$$

In the above formulae, the letter λ denotes a forgetting coefficient. Further, the notation $$\Delta S_i^{act}[n]$$

denotes the gap error change amount between the preceding material and the present material and is calculated by using Mathematical Formula (5) presented below.

[Math 5]

$$\Delta S_i^{act}[n] = S_i^{error}[n] - S_i^{error}[n-1] \tag{5}$$

In the above formula, the notations $$S_i^{error}[n] \text{ and } S_i^{error}[n-1]$$

denote the actual gap error of the n-th coil (the present material) and that of the (n−1)-th coil (the preceding material), respectively. Further, according to Mathematical Formula (4) presented above, calculating p[n] needs the value p[n−1] of the preceding material. Thus, the initial value of p[n] is calculated from Mathematical Formula (6) presented below by using results from m coils rolled most recently, instead of using Mathematical Formula (4) presented above.

[Math 6]

$$p[n] = \left(\sum_{j=n-m}^{n} \lambda^{n-j} (\Delta P_i[j])^2\right)^{-1} \tag{6}$$

Further, it is possible to determine the initial value of a[n] by performing a regression analysis on coils that have so far been rolled, for example.

According to the present embodiment, the changes in the rigidity of the rolling mill 5 are grasped as the regression coefficients of the regression model that are recursively identified. As a result, the appropriate gap correction amounts are automatically calculated. Consequently, it is possible to reduce the impact imposed on the precision level of the calculation of the gap stetting values by the chronological changes in the rigidity of the rolling mill 5, i.e., the changes in the thickness errors associated with the roll force changes between the preceding materials and the present materials. Further, the calculated gap correction amounts are in proportion to the values of the regression coefficient a[n]. Accordingly, when the regression coefficient is small, i.e., when there is a small correlation between the roll force change amount between the preceding material and the present material and the gap error change amount, the absolute value of the calculated gap correction amount is inevitably small. It is therefore possible to prevent the gap of the finishing mill 5 from being excessively corrected. On the contrary, when there is a large correlation between the roll force change amount between the preceding material and the present material and the gap error change amount, the absolute value of the calculated gap correction amount is inevitably large. It is therefore possible to prevent the gap of the finishing mill 5 from being insufficiently corrected.

Second Embodiment

A second embodiment is different in that a difference is calculated between the gap error change amount calculated from the regression model by using the actual roll force and the actual gap error change amount, so as not to update the regression coefficient a[n] if the difference is larger than a reference value. In the second embodiment, some of the features that are duplicate of the first embodiment will not be explained.

Regarding the n-th rolled coil, Mathematical Formula (7) presented below is used for calculating an error E[n] between the actual value $$\Delta S_i^{act}[n]$$

of the gap error change amount between the preceding material and the present material and the predicted value $$\Delta S_i^{pred}[n]$$

of the gap error change amount between the preceding material and the present material.

[Math 7]

$$E[n] = \left|\Delta S_i^{act}[n] - \Delta S_i^{pred}[n]\right| \tag{7}$$

When the error E[n] is larger than the certain reference value (an upper limit value), the gap error of the present material (the n-th coil) is regarded as an outlier. The regression coefficient a[n] is not updated, and the regression coefficient a[n] from the rolling of the preceding material is maintained. In this situation, the value $$\Delta S_i^{pred}[n]$$

is calculated by using Mathematical Formula (8) presented below.

[Math 8]

$$\Delta S_i^{pred}[n] = a[n] \cdot \Delta P_i^{act}[n] \tag{8}$$

According to the present embodiment, in the situation where the actual value of the gap error change amount of the present material includes noise, for example, the gap error in that situation is regarded as an outlier, and the regression coefficient a[n] is not updated. It is therefore possible to prevent the gap of the finishing mill 5 from being excessively corrected. As a result, it is possible to control the thicknesses with a higher level of precision.

Third Embodiment

Figure 4:
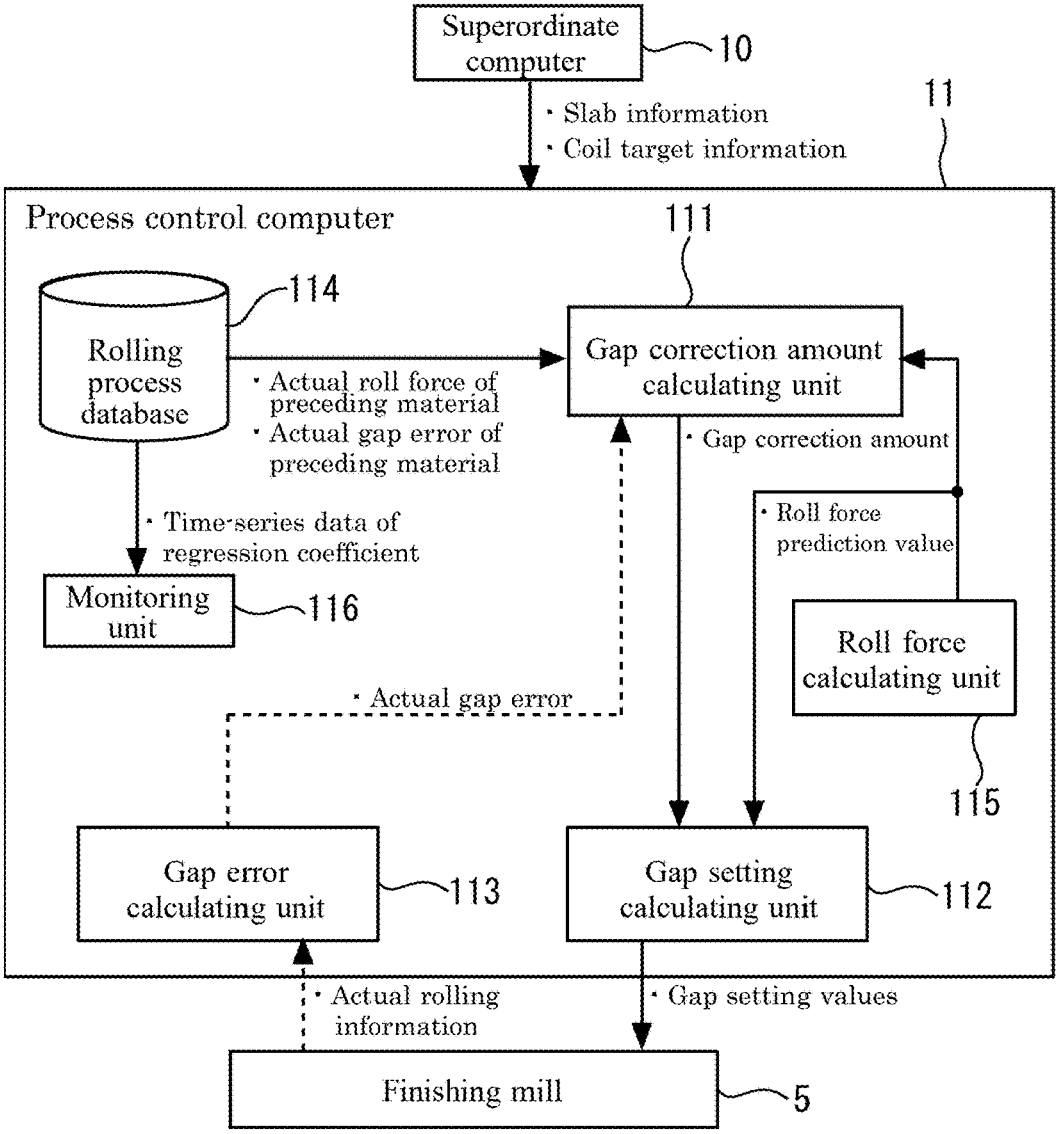
FIG. 4 is a schematic diagram indicating a configuration of the process control computer that implements a rigidity monitoring method for a rolling mill according to a third embodiment.

FIG. 4 is a schematic diagram indicating a configuration of the process control computer 11 that implements a rigidity monitoring method for a rolling mill according to a third embodiment.

The present embodiment is different from the first and the second embodiments in that the process control computer 11 includes a monitoring unit 116. In the following sections, the difference will primarily be explained.

The regression coefficient a[n] calculated by the gap correction amount calculating unit 11 is successively saved in the rolling process database 14. The monitoring unit 116 monitors time-series data of the regression coefficient a[n]. On the basis of a tendency change in the regression coefficient a[n], the monitoring unit 116 detects a change in the rigidity of the finishing mill 5 and issues a notification. The tendency change in the regression coefficient a[n] can be determined by using a change point detection method, for example. The change point detection method is a method used for determining a point at which the tendency change in data values can be observed, from the time-series data of the regression coefficient a[n]. Known examples include a method called Change Finder by which the change point is detected from two-stage learning using a time-series model such as an auto-regressive model, for example. As a more robust method, it is also acceptable to determine the tendency change on the basis of a threshold value provided appropriately with respect to the regression coefficient a[n]. In another example, it is also acceptable to determine the tendency change by using both of those methods together. Further, as for methods for the notification, an alarm may be issued as a warning sound, or information may be displayed on the interface screen 12.

Figure 5:
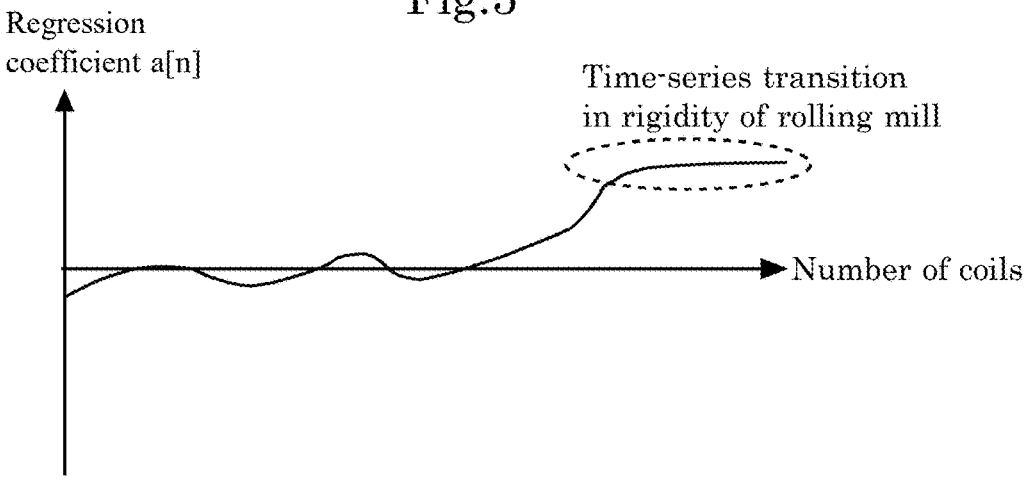
FIG. 5 is a schematic chart for explaining an example of transition of the regression coefficient.
Figure 6:
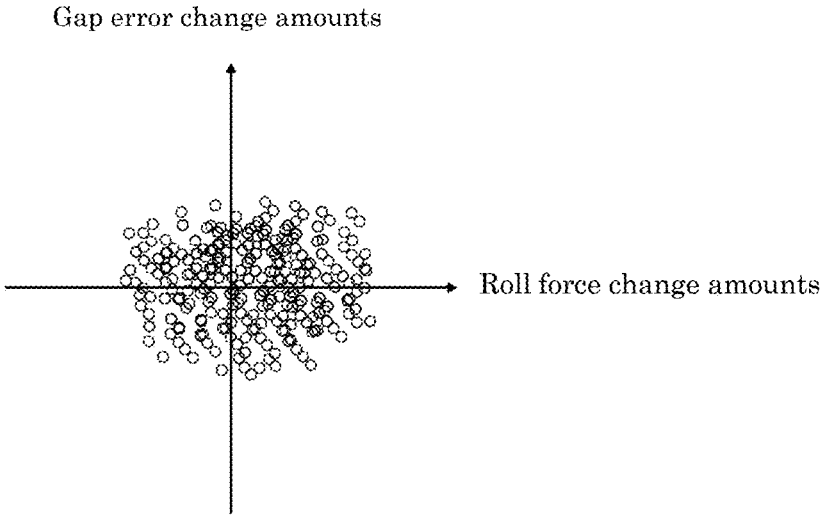
FIG. 6 is a graph showing an example in which a correlation is observed between roll force change amounts and gap error change amounts.
Figure 7:
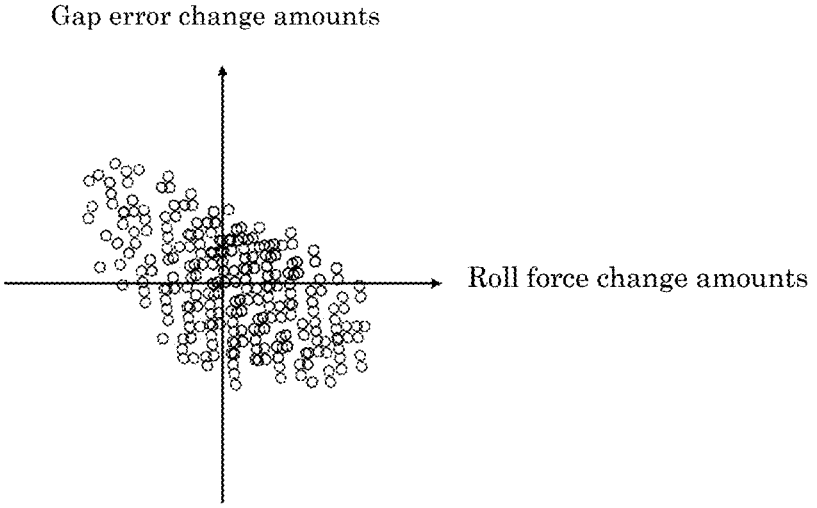
FIG. 7 is a graph showing an example in which a correlation is observed between roll force change amounts and gap error change amounts.

FIG. 5 is a schematic chart for explaining an example of transition of the regression coefficient a[n]. In FIG. 5, in the area circled with the broken line, the regression coefficient a[n] has an increasing tendency. On the basis of such a tendency change in the regression coefficient a[n], the monitoring unit 116 detects a change in the rolling mill rigidity and informs the operator.

According to the present embodiment, by monitoring the regression coefficient a [n], while regarding the transition of the regression coefficient a[n] along the time series as the chronological changes in the rigidity of the finishing mill 5, it is possible to grasp the changes occurring in the rigidity of the finishing mill 5. Consequently, it is possible to prompt users to adjust parameters of the gauge meter model and to perform the mill curve measuring process. It is therefore possible to avoid the situation where the precision level for controlling the thickness of the material to be rolled M becomes degraded gradually.

Certain embodiments of the present invention have thus been explained; however, the present invention is not limited to the embodiments described above. It is possible to carry out the invention with various modifications without departing from the gist of the present invention. Further, as for the quantities, the numerical values, the amounts, and the ranges of the elements described in the embodiments, the present invention is not limited by the stated numbers, unless the limitation is particularly noted or the numbers should evidently be so specified in principle. Further, the structures and the like described in the above embodiments are not necessarily requisite in the present invention, unless the requisition is particularly noted or the configurations should evidently be so specified in principle.

REFERENCE SIGNS LIST

5 . . . Finishing mill (Rolling mill), M . . . Material to be rolled

The invention claimed is:

1. A thickness controlling method for a rolling mill that rolls a material to be rolled so as to have a target thickness, the thickness controlling method comprising:

a step of using a regression model to recursively approximate a relationship between a roll force change amount between a preceding material and a present material and a gap error change amount of the rolling mill, and predicting a gap error in a rolling of the present material on the basis of the regression model, the preceding material being a rolled coil rolled by the rolling mill immediately prior, and the present material being another rolled coil to be rolled following the preceding material;

a step of correcting a gap setting amount in the rolling of the present material, on a basis of a value of the predicted gap error; and a step of updating a regression coefficient of the regression model, on a basis of an actual roll force and an actual gap error change amount obtained from the rolling of the present material.

2. The thickness controlling method for the rolling mill according to claim 1, wherein a difference is calculated between the gap error change amount predicted by the regression model by using the actual roll force and the actual gap error change amount, and when the calculated difference is larger than a reference value, the regression coefficient is not updated, and a most recent regression coefficient is maintained.

3. A rigidity monitoring method for a rolling mill comprising:

a step of determining whether there is a chronological change in rigidity of the rolling mill on a basis of a time-series transition in the regression coefficient updated at each rolling with the thickness controlling method for the rolling mill according to claim 1; and a step of issuing a notification when it is determined that the chronological change has occurred in the rigidity of the rolling mill.

4. A rigidity monitoring method for a rolling mill comprising:

a step of determining whether there is a chronological change in rigidity of the rolling mill on a basis of a time-series transition in the regression coefficient updated at each rolling with the thickness controlling method for the rolling mill according to claim 2; and a step of issuing a notification when it is determined that the chronological change has occurred in the rigidity of the rolling mill.

* * * * *